US007505017B1

(12) United States Patent
Yeo et al.

(10) Patent No.: US 7,505,017 B1
(45) Date of Patent: Mar. 17, 2009

(54) METHOD OF DRIVING LIQUID CRYSTAL DISPLAY

(75) Inventors: Ju Cheon Yeo, Anyang-shi (KR); Yong Min Ha, Anyang-shi (KR); Sang Young Yoon, Inchon (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 09/515,239

(22) Filed: Mar. 6, 2000

(30) Foreign Application Priority Data

Mar. 6, 1999 (KR) ..... 1999-7445

(51) Int. Cl.
*G09G 3/36* (2006.01)

(52) U.S. Cl. ..... 345/88; 345/87

(58) Field of Classification Search ..... 345/38, 345/598, 30, 89–111, 87, 88; 349/33, 41, 349/106, 143, 44; 340/703
See application file for complete search history.

(56) References Cited

U.S. PATENT DOCUMENTS

| | | | | |
|---|---|---|---|---|
| 4,800,375 | A * | 1/1989 | Silverstein et al. | 349/106 |
| 5,122,783 | A * | 6/1992 | Bassetti, Jr. | 345/593 |
| 6,040,814 | A * | 3/2000 | Murakami et al. | 345/94 |
| 6,323,871 | B1 * | 11/2001 | Fujiyoshi et al. | 345/598 |
| 6,628,253 | B1 * | 9/2003 | Hiroki | 345/87 |
| 6,628,356 | B2 * | 9/2003 | Shimada et al. | 349/106 |
| 6,864,940 | B2 * | 3/2005 | Shimada et al. | 349/143 |

FOREIGN PATENT DOCUMENTS

| | | | |
|---|---|---|---|
| DE | 198 01 318 | A1 | 10/1998 |
| DE | 198 25 276 | A1 | 1/1999 |
| EP | 0 293 048 | A2 | 11/1988 |
| GB | 2 325 329 | A1 | 11/1998 |
| GB | 2325329 | | 11/1998 |
| GB | 2333174 | | 7/1999 |
| JP | 02-077793 | A1 | 3/1990 |
| WO | WO 97/24706 | A2 | 7/1997 |

OTHER PUBLICATIONS

Search Report dated Jun. 22, 2000.

* cited by examiner

*Primary Examiner*—Sumati Lefkowitz
*Assistant Examiner*—Srilakshmi K Kumar
(74) *Attorney, Agent, or Firm*—McKenna Long & Aldridge LLP

(57) ABSTRACT

A liquid crystal display driving method that is adapted to enhance a quality of picture to be displayed on a liquid crystal panel and prevents a distortion of picture. The liquid crystal display driving method drives a liquid crystal display device including a plurality of demultiplexers connected between a data driving circuit and data lines on a liquid crystal panel, and classifying color data signals to be applied to the respective demultiplexers data driver by colors and allowing the color data signals having a same color to be continuously supplied to the data lines by the demultiplexers prior to a different color signal having a different color.

20 Claims, 14 Drawing Sheets

METHOD OF DRIVING LIQUID CRYSTAL DISPLAY

This application claims the benefit of Korean Patent Application No. P99-7445, filed on Mar. 6, 1999, which is hereby incorporated by reference.

BACKGROUND OF THE INVENTION

1. Field of the Invention

This invention relates to a liquid crystal display using a thin film transistor (hereinafter, TFT) as a switching element, and more particularly, to a liquid crystal display driving method for optimizing a sequence of data signals to enhance a picture quality.

2. Description of the Related Art

The conventional liquid crystal display device employees a picture element matrix including gate lines and data lines in order to display a picture corresponding to a video signal. The picture element matrix includes a plurality of picture elements arranged at the intersections of the gate lines and data lines. Each picture element has a liquid crystal cell for controlling a quantity of light passing thereon and a TFT for switching the video signal to be applied from the data line to the liquid crystal cell. The liquid crystal display device is provided with gate driving IC (Integrated Circuit) chips and a data driving IC (hereinafter, data D-IC) chips.

Recently, a liquid crystal display driving method using demultiplexers so as to simplify the circuit configuration of the liquid crystal display device. The demultiplexers are connected between the D-IC chips and the picture element matrix. Each demultiplexer connects selectively a plurality of data lines with one output terminal of the data D-IC chip to decrease a number of data D-IC chips. For example, if a number of data lines is "n" and a number of the selective terminals of demultiplexer is "m", the data D-IC chip has output lines of "k=n/m". In other words, the number of data D-IC chips to be used for the liquid crystal display device is reduced by 1/m. In this case, the data D-IC chip outputs sequentially m data signals to the demultiplexer during each period of horizontal synchronous signal. The demultiplexer distributes the m data signals from the data D-IC chip to m data lines. Also, the demultiplexers can be formed on a substrate with the picture element matrix in case that the liquid crystal display device includes TFTs formed by a poly-silicon having a fast mobility. Further, the demultiplexer requires control signals corresponding to the number of data lines which control the sequence of connection of the data lines to one output terminal of the data D-IC chip. Such a liquid crystal display driving method using demultiplexers will be described in reference to FIGS. 1 and 2 as follows.

Referring to FIG. 1, there is illustrated a conventional liquid crystal display device including a first to kth demultiplexers DEMUX1 to DEMUXk connected between a data D-IC chip 12 and n data lines DL1 to DLn on a liquid crystal panel 10. The data D-IC chip 12 has k output terminals corresponding to the k demultiplexers DEMUX1 to DEMUXk. The k demultiplexers DEMUX1 to DEMUXk have 5 output terminals each connected to the data lines DL1 to DLn on the liquid crystal panel 10 and receive commonly first to fifth control signals CS1 to CS5. The first to fifth control signals CS1 to CS5 are sequentially enabled at a high logic state during one horizontal synchronous period (i.e., 1H), as shown in FIG. 2. Also, the conventional liquid crystal display device has a gate D-IC chip 14 for driving m gate lines GL1 to GLm on the liquid crystal panel 10. The gate D-IC chip 14 applies sequentially a gate scanning signal GSS to the m gate lines GL1 to GLm by one horizontal synchronous period increments. The gate scanning signal GSS maintains a high logic state during one horizontal synchronous period, as shown in FIG. 2. When any one among the m gate lines is driven during one horizontal synchronous period, the data D-IC chip 12 supplies sequentially 5 data signal groups to the k demultiplexers DEMUX1 to DEMUXk synchronously with the control signal CS1 to CS5. Each demultiplexer DEMUX1 to DEMUXk responds to the first to fifth control signals CS1 to CS5 and distributes the 5 color signals input sequentially from the output terminal of the data D-IC chip 12 to the 5 data lines. In particular, the first demultiplexer DEMUX1 transmits sequentially 5 color data signal R1, G1, B1, R2 and G2 from the data D-IC chip 12 to the first through fifth data lines DL1 to DL5, as shown in FIG. 2. Similarly, the second demultiplexer DEMUX2 applies 5 color data signals B2, R3, G3, B3 and R4 from the data D-IC chip 12 to the sixth through tenth data lines DL6 to DL10 on the liquid crystal panel 10, as shown in FIG. 2. To this end, each demultiplexer DEMUX1 to DEMUXk includes 5 transistors MN1 to MN5 responding respectively to the control signals CS1 to CS5.

The conventional liquid crystal display driving method as described above allows a data signal on any one of the data lines DL1 to DLn to be distorted by another data signal supplied to an adjacent data line due to a coupling capacitor between the adjacent data lines. Actually, the first data line DL1 receives a first red data signal R1 from the first MOS transistor MN1 of the first demultiplexer DEMUX1 during the high logic period of the first control signal CS1, as shown in FIG. 3A. Also, the first data line DL1 is floated at the low logic period of the first control signal CS1. Then, the second data line DL2 inputs a first green data signal G1 from the second MOS transistor MN2 of the first demultiplexer DEMUX1 during the high logic period of the second control signal CS2 which is enabled after the first control signal CS1. Due to a coupling capacitor Cc between the first and second data lines DL1 and DL2, the first red data signal R1 charged in a picture element on the first data line DL1 varies or become affected by first green data signal G1 on the second data line DL2. As a result a picture displayed on the liquid crystal panel 10 becomes distorted.

Such a distortion is extreme where the liquid crystal panel 10 is driven in a dot inversion system. In particular, the voltage signal DLS1 on the first data line DL1 increases by the first red data signal R1 of positive voltage level during the high logic period of the first control signal CS1 and then falls by an undesirable voltage level, as shown in FIG. 3B. This results from the first green data signal G1 of negative voltage level being applied from the second data line DL2 to the first data line DL1 through the coupling capacitor Cc at the rising edge of the second control CS2. Also, the voltage signal DLS1 on the first data line DL1 falls once more by an undesirable voltage level at the rising edge of the fifth control signal CS5. Meanwhile, the voltage signal DLS2 on the second data line DL2 decreases during the high logic period of the second control signal CS2 and rises only once by an arbitrary voltage level at the rising edge of the third control signal CS3. This is because the first blue data signal B1 of positive voltage level on the third data line DL3 is applied to the second data line DL2 through the coupling capacitor Cc at the rising edge of the third control signal CS3. Accordingly, the picture elements on the data lines connected to the first output terminals of the demultiplexers DEMUX1 to DEMUXk receive a voltage signal that is lower or higher than the picture elements on the data lines connected to the second to fifth output terminals of the demultiplexers DEMUX1 to DEMUXk. Thus, some picture elements are displayed with reduced brightness relative to other picture elements. As a result, the picture displayed on the liquid crystal panel 10 is distorted greatly.

The conventional liquid crystal display driving method forces the same color data signals to be displayed with brightness different from each other depending on the applying sequence thereof. As a result, the distorted picture including stripes can be displayed on the liquid crystal panel. For example, where a liquid crystal panel of dot inversion system is driven by the conventional liquid crystal display driving method, stripes appear on the displayed picture on the liquid crystal panel 10. The stripes appear because the absolute values of voltage signals charged in the picture elements on the data lines receiving the same color data signal are different as shown in FIG. 4. FIG. 4 shows waveforms of voltage signals on the data lines DL6, DL7, DL9 and DL10 connected to the second demultiplexer DEMUX2 when the ith and (i+1) th gate lines GLi and Gli+1 are sequentially driven by the scanning signals GSSi and GSSi+1. In this case, the second demultiplexer DEMUX2 receives sequentially second blue data signal B2, third red, green and blue data signals R3, G3 and B3 and fourth red data signal R4. The second and third blue data signals each have the same absolute voltage value but opposite in electric polarity. The third and fourth red data signals are equal in the absolute voltage value but opposite of each other in the electric polarity. Further, the second blue data signal B2, third red, green and blue data signals R3, G3 and B3 and fourth red data signal R4 are inverted in the electric polarity. The sixth data line DL6 charges the second blue data signal B2 from the first MOS transistor MN1 of the second demultiplexer DEMUX2 during the high logic period of the first control signal CS1. The sixth data line DL6 must be floated while the first control signal CS1 is in the low logic state. However, the sixth data line DL6 discharges the charged voltage signal DLS6 to the adjacent data lines DL7 through the coupling capacitor Cc at the rising edge of the second control signal CS2, from the third red data signal R3 of negative voltage level on the seventh data line DL7. Also, the sixth data line DL6 discharges again the charged voltage signal DLS6 to the fifth data line DL5 through the coupling capacitor Cc by a second green data signal G2 of negative voltage level (not shown) at the rising edge of the fifth control signal CS5. On the other hand, the ninth data line DL9 discharges only once after charging the third blue data signal B3. In particular, the ninth data line DL9 charges the third blue data signal B3 from the fourth MOS transistor MN4 of the second demultiplexer DEMUX2 during the high logic period of the fourth control signal CS4. The ninth data line DL9 discharges the charged voltage signal DLS9 to the tenth data line DL10 through the coupling capacitor at the rising edge of the fifth control signal CS5, due to the fourth red data signal R4 of positive voltage level. As described above, the sixth data line DL6 discharges once more than the ninth data line DL9 such that the voltage signal DLS6 has an absolute voltage value lower than that of the voltage signal DLS9 on the ninth data line DL9 at the falling edge of the ith scanning signal GSSi (i.e., a sampling time point of data signals) even if the same data voltages were applied. Also, the seventh data line DL7 discharges once more than the tenth data line DL10. In particular, the seventh data line DL7 charges the third red data signal R3 from the second MOS transistor MN2 of the second demultiplexer DEMUX2 during the high logic period of the second control signal CS2. The seventh data line DL7 discharges the charged voltage signal once to the eighth data line DL8 through the coupling capacitor Cc formed between the seventh and eighth data lines DL7 and DL8 at the rising edge of the third control signal CS3, due to the third green data signal G3 having the positive voltage level. Thus, the seventh data line DL7 provides the voltage signal DLS7 having an absolute value lower than the third red data signal R3 at the falling edge of the ith gate scanning signal GSSi. Meanwhile, the tenth data line DL10 charges the fourth red data signal R4 from the fifth MOS transistor MN5 of the second demultiplexer DEMUX2 during the high logic period of the fifth control signal CS5. The tenth data line DL10 maintains the voltage signal DLS10 equal to the voltage level of the fourth red data signal R4 until the falling edge of the ith gate scanning signal GSSi (i.e., the sampling time point of data signal). The color data signals are applied to the picture elements with different absolute voltage values depending on the sequence of applying them to the data lines DL1 to DLn, thereby distorting the picture displayed on the liquid crystal panel 10.

Further, the conventional liquid crystal display driving method forces an amount of leakage current on each data line DL1 to DLn to be different depending on the applying sequence of the data signals. The difference in leakage currents on the data lines DL1 to DLn results because the holding period of the picture element varies with the applying sequence of the data signals. The difference in the leakage currents on the data lines DL1 to DLn forces the data signals having the same voltage value to be sampled respectively to the picture elements in a varied or distorted state with different absolute voltage values, as shown in FIG. 5. In particular, the first data line DL1 charges a first red data signal R1 from the first MOS transistor MN1 of the first demultiplexer DEMUX1 during the high logic period of the first control signal CS1. The first data line DL1 maintains the charged voltage until the falling edge of the gate scanning signal GSS. The voltage charged in the first data line DL1 leaks out during the long period from the falling edge of the first control signal CS1 to the falling edge of the gate scanning signal GSS. Consequently, the first data line DL1 provides the picture element with a first voltage signal DLS1 which is lower than the first red data signal R1 by a voltage of ΔV1, as shown in FIG. 5. Meanwhile, the fourth data line DL4 charges a second red data signal R2 from the fourth MOS transistor MN4 of the first demultiplexer DEMUX1 during the high logic period of the fourth control signal CS4. The fourth data line DL4 maintains the charged voltage until the falling edge of the gate scanning signal GSS. The voltage charged in the fourth data line DL4 leaks out during the short period from the falling edge of the fourth control signal CS4 to the falling edge of the gate scanning signal GSS. Consequently, the fourth data line DL4 supplies the picture element with the fourth voltage signal DLS4 which is lower than the second red data signal R2 by a voltage of ΔV2. FIG. 5 illustrates how the voltage level of the fourth voltage signal DLS4 is higher than that of the first voltage signal DLS1. Thus, the picture displayed on the liquid crystal panel 10 is distorted and furthermore the quality of picture is degraded.

As described above, the conventional liquid crystal display driving method forces the same color data signals to be applied respectively to the picture elements in such a manner as to have the voltage level different from each other, thereby distorting the picture displayed on the liquid crystal panel. Accordingly, the conventional liquid crystal display driving method deteriorates the quality of picture displayed on the liquid crystal panel.

SUMMARY OF THE INVENTION

Accordingly, the present invention is directed to a liquid crystal display driving system that substantially obviates one or more of the problems, limitations and disadvantages of the related art.

Accordingly, it is an object of the present invention to provide a liquid crystal display driving system and method that is adapted to enhance a quality of picture displayed on a liquid crystal panel and to prevent a distortion.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

In order to achieve this and other objects of the invention, a liquid crystal display apparatus according to one aspect of the present invention drives a liquid crystal display device including a plurality of demultiplexers connected between a data driving circuit and data lines on a liquid crystal panel. Color data signals, which are applied to the demultiplexers, are classified by colors to be continuously applied to the data lines via the demultiplexers in respective color.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
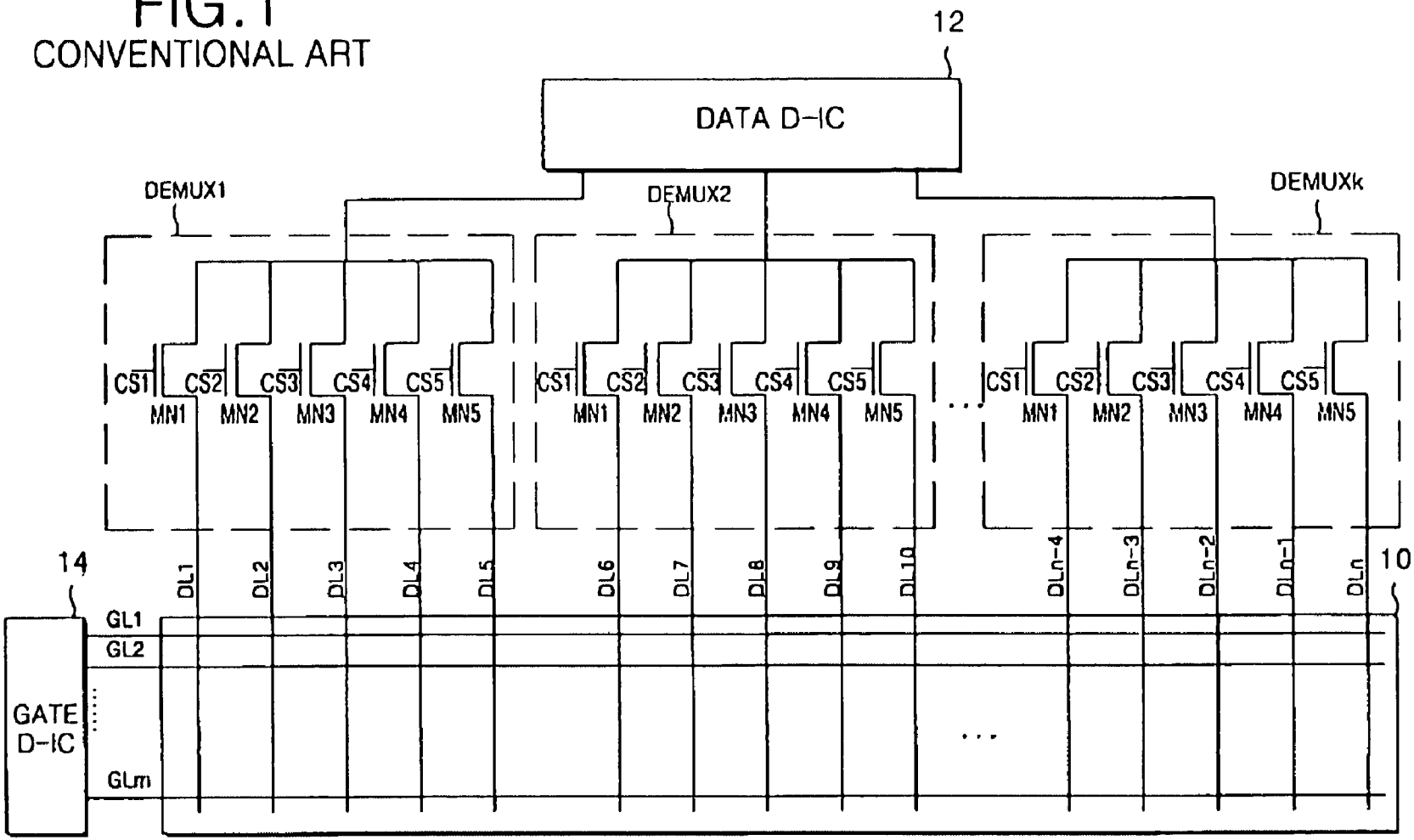
FIG.1 CONVENTIONAL ART
FIG. 1 is a schematic view showing the liquid crystal display device which is driven in the conventional liquid crystal display driving method.
Figure 2:
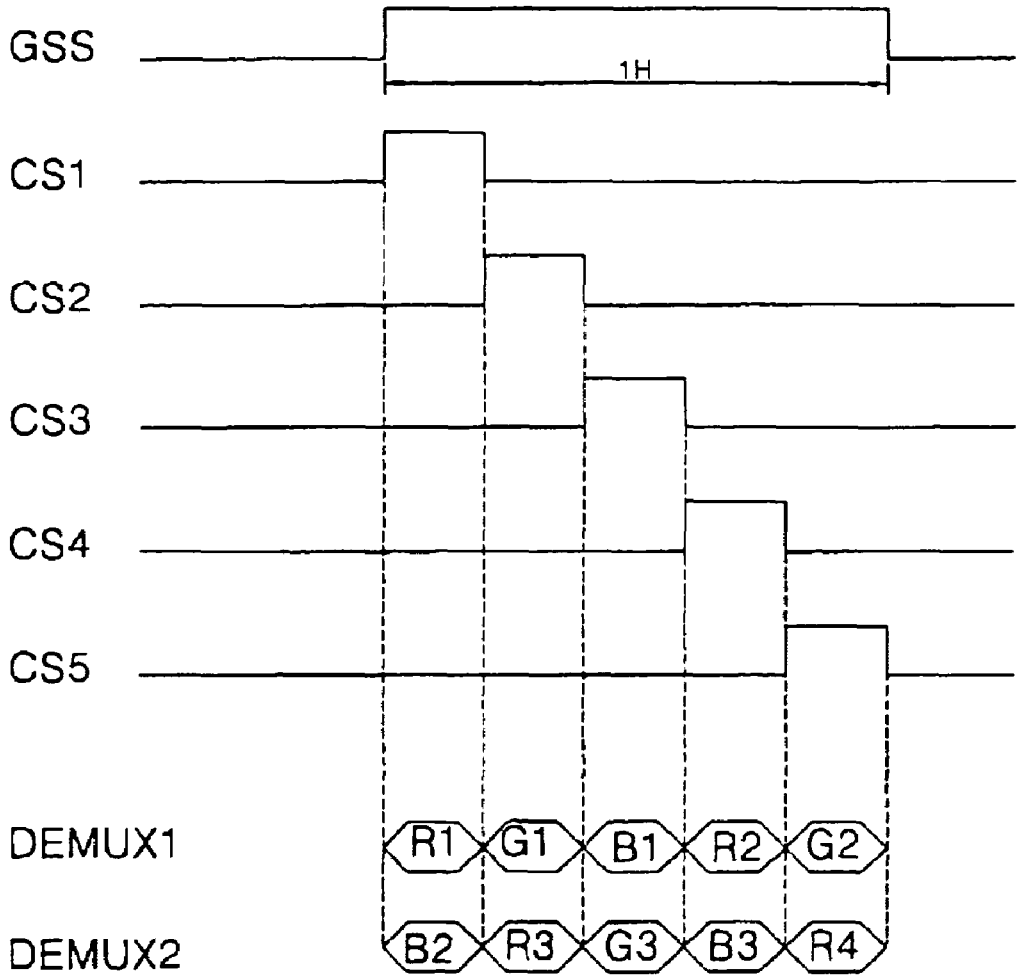
FIG.2 CONVENTIONAL ART
FIG. 2 is a waveform diagram of signals applied to each portion of the liquid crystal display device as shown in FIG. 1.
Figure 3A:
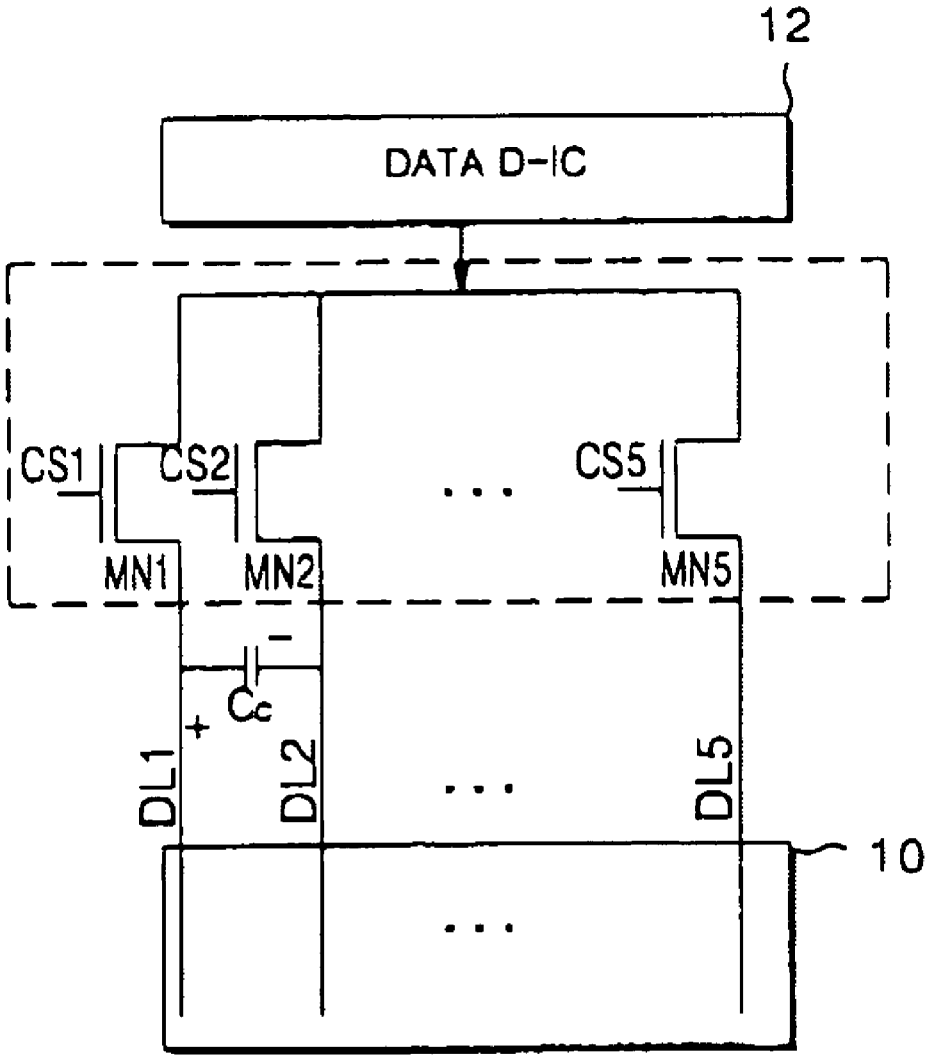
FIG.3A CONVENTIONAL ART
FIG. 3A is a schematic view showing the configuration of liquid crystal display device with a dot inversion system which is driven in the conventional liquid crystal display driving method.
Figure 3B:
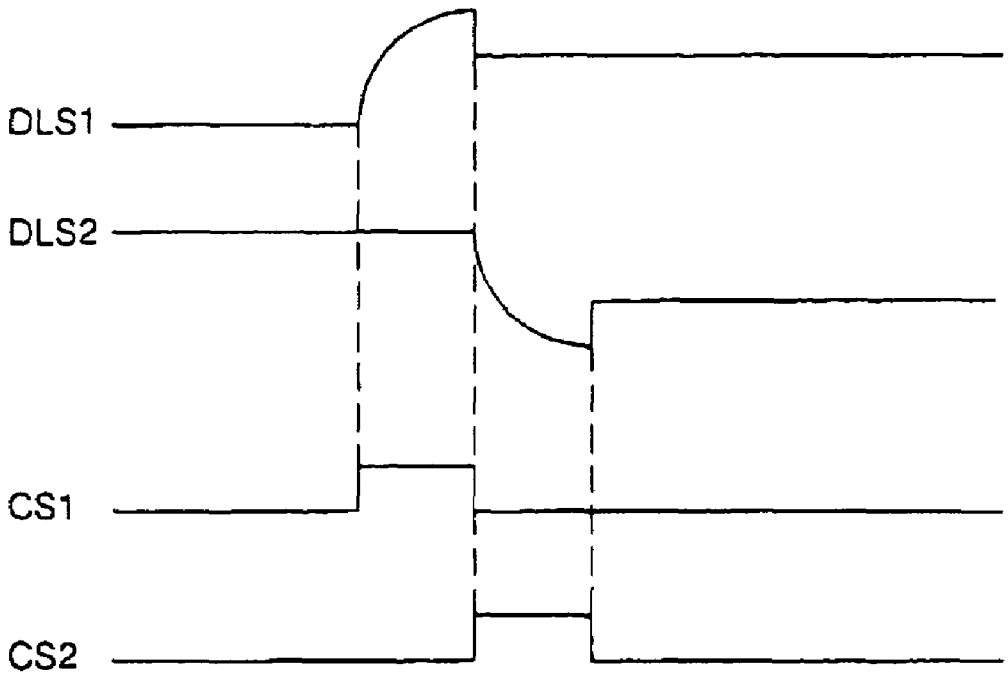
FIG.3B CONVENTIONAL ART
FIG. 3B is a waveform diagram of signals applied to each portion of the liquid crystal display device as shown in FIG. 3A.
Figure 4:
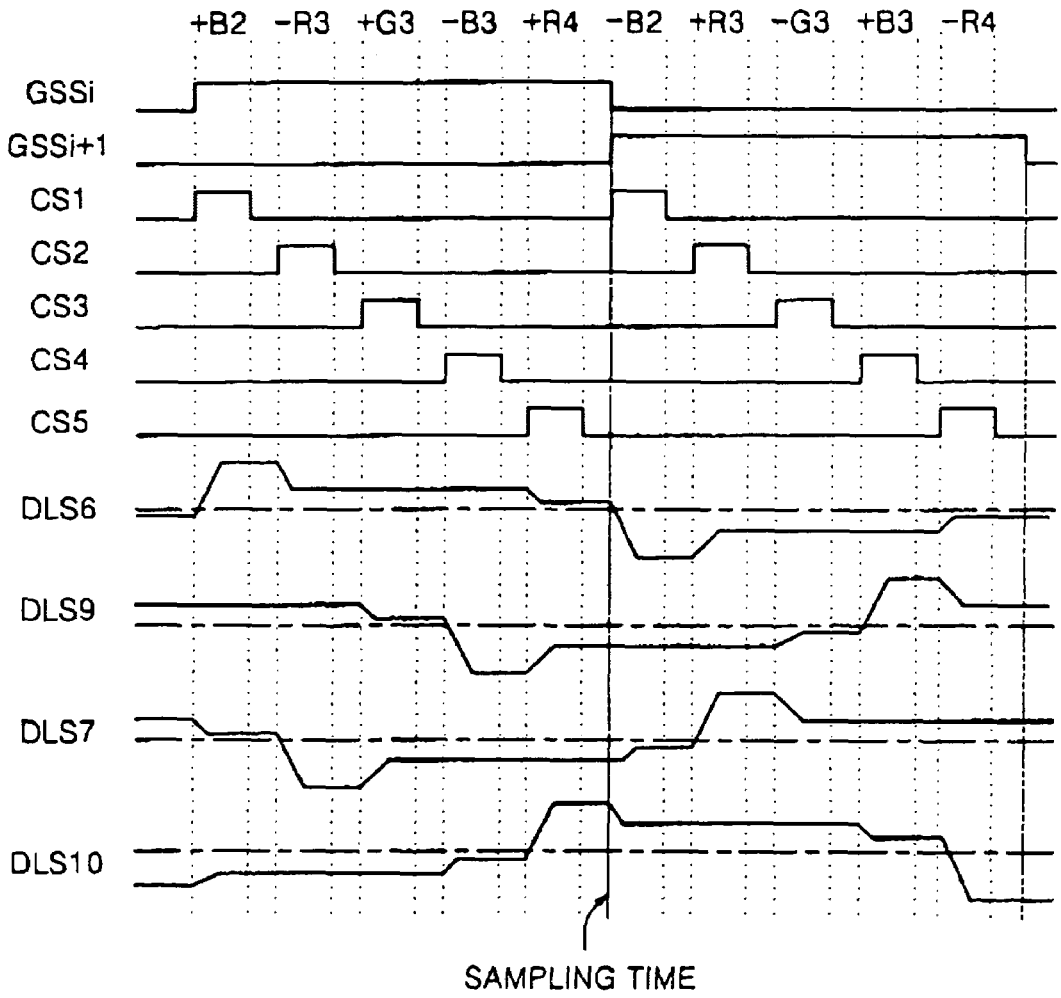
FIG.4 CONVENTIONAL ART
FIG. 4 shows waveforms of voltage signals on data lines DL6, DL7, DL9 and DL10 connected to the second demultiplexer DEMUX2 when the ith and (i+1)th gate lines GLi and GLi+1 are sequentially driven the scanning signals GSSi and GSSi+1.
Figure 5:
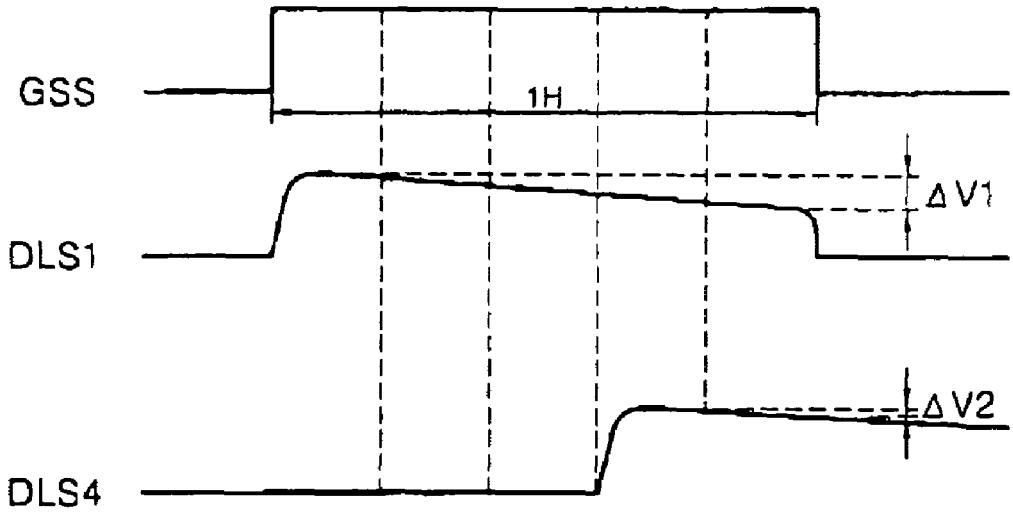
FIG.5 CONVENTIONAL ART
FIG. 5 is a waveform diagram for explaining the difference in leakage currents on the data lines DL1 and DLn of the liquid crystal panel when the data lines are sequentially driven.
Figure 6:
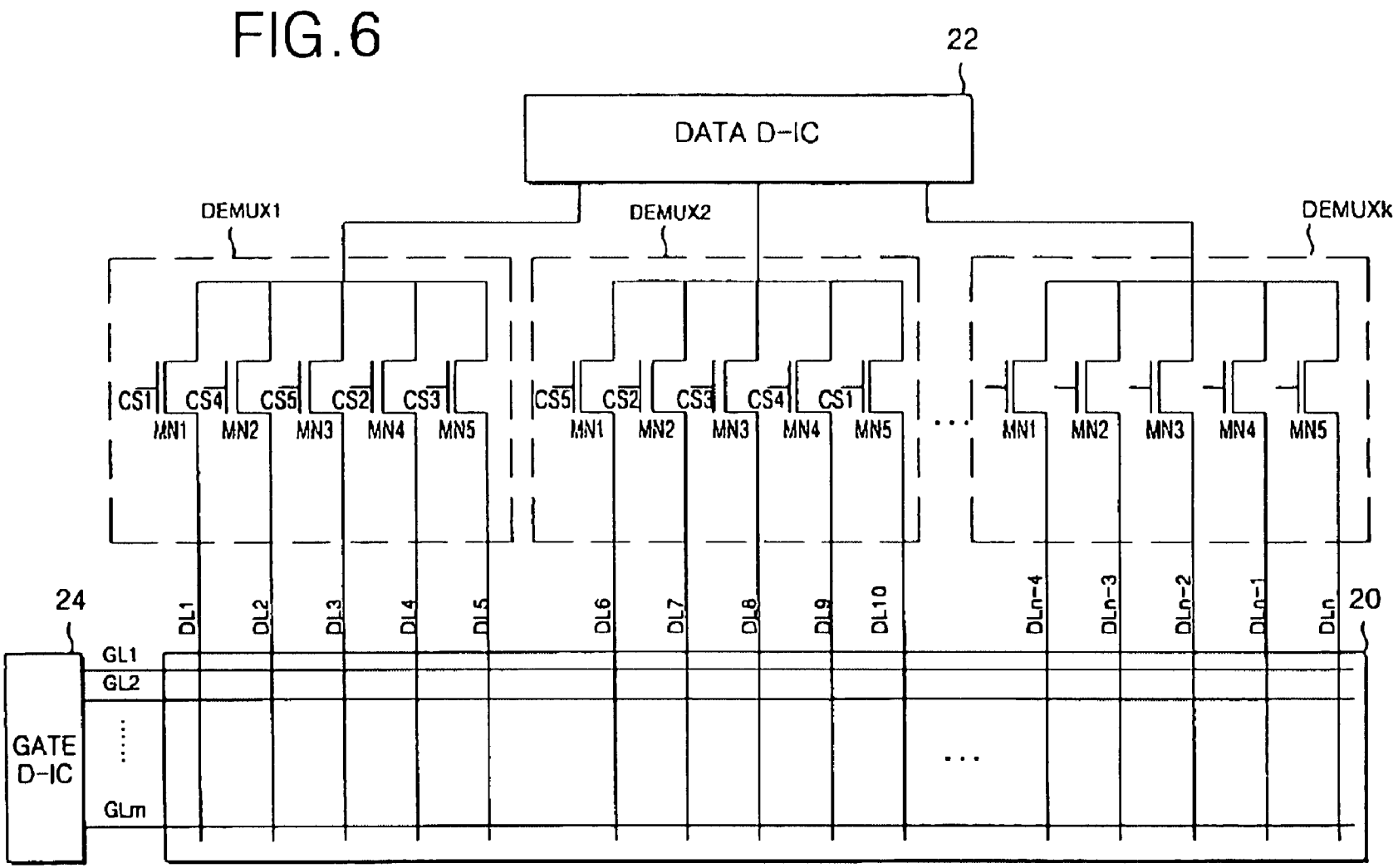
FIG. 6 is a schematic view showing the configuration of the liquid crystal display device which is driven in a liquid crystal display driving method according to an embodiment of the present invention.
Figure 7:
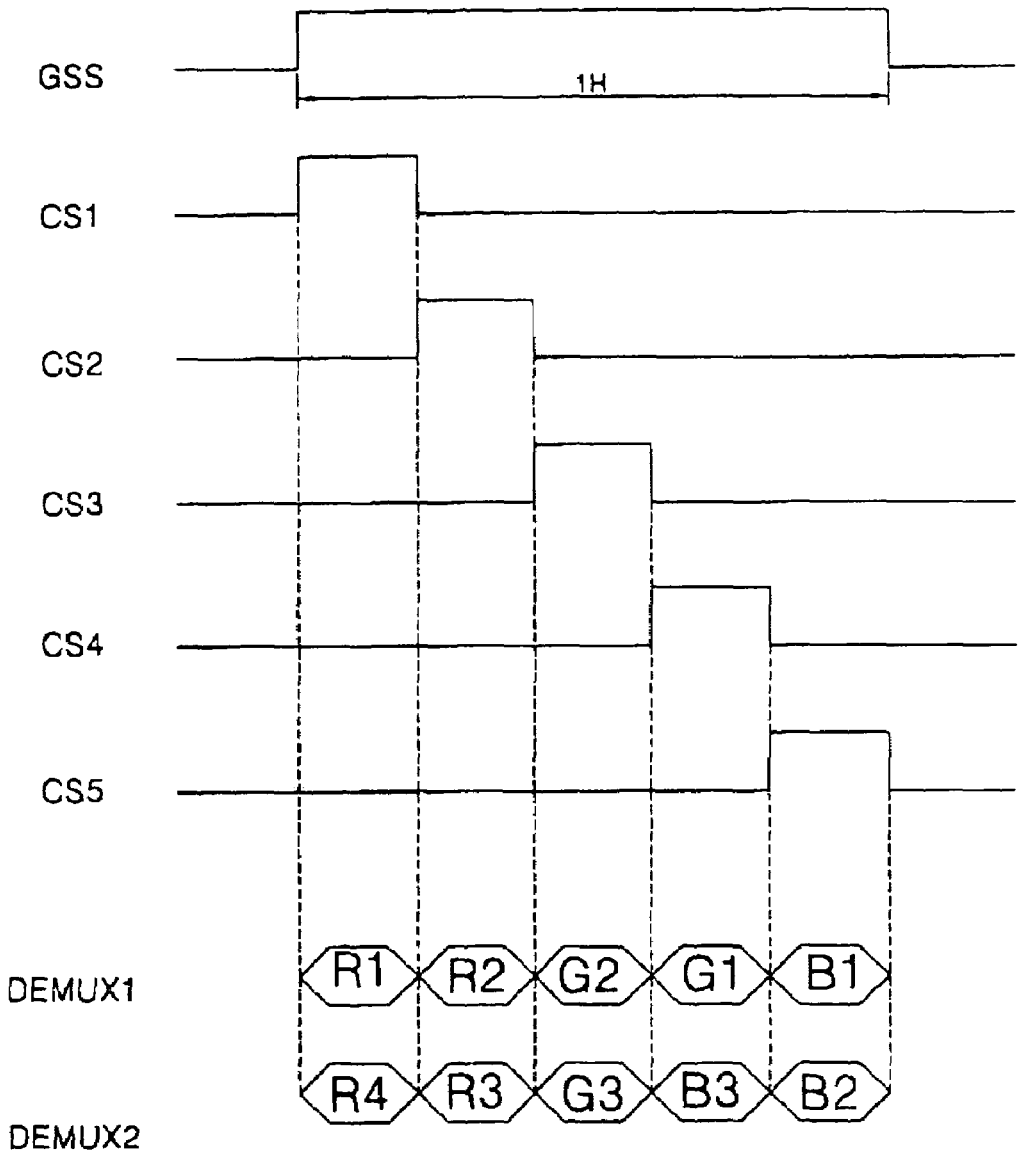
FIG. 7 is a waveform diagram of signals applied to each portion of the liquid crystal display device as shown in FIG. 6.

Preferred embodiments of the present invention for preventing a picture distortion will be described In particular with reference to FIG. 6 to FIG. 13 below. FIG. 6 is a schematic view of a liquid crystal display device for explaining a liquid crystal display method according to a first embodiment of the present invention. In FIG. 6, the liquid crystal display device includes first to kth demultiplexers DEMUX1 to DEMUXk connected between a data D-IC chip 22 and n data lines DL1 to DLn on a liquid crystal panel 20. The data D-IC chip 22 has k output terminals opposite to the k demultiplexers DEMUX1 to DEMUXk. The k demultiplexers DEMUX1 to DEMUXk have 5 output terminals each connected to the data lines DL1 to DLn on the liquid crystal panel 20 and receive commonly first to fifth control signals CS1 to CS5. The first to fifth control signals CS1 to CS5 are sequentially enabled at a high logic state during one horizontal synchronous period (i.e., 1H), as shown in FIG. 7. The demultiplexers DEMUX1 to DEMUXk each have 5 MOS transistors MN1 to MN5. Also, the liquid crystal display device has a gate D-IC chip 24 for driving m gate lines GL1 to GLm on the liquid crystal panel 20. The gate D-IC chip 24 applies sequentially a gate scanning signal GSS to the m gate lines GL1 to GLm, where each gate line is driven for one horizontal synchronous period. The gate scanning signal GSS maintains the high logic state for one horizontal synchronous period, as shown in FIG. 7. When any one of the m gate lines is driven during one horizontal synchronous period, the data D-IC chip 22 supplies sequentially 5 data signal groups including k color data signals to the k demultiplexers DEMUX1 to DEMUXk synchronously with the control signals CS1 to CS5. Each demultiplexer DEMUX1 to DEMUXk responds to the first to fifth control signals CS1 to CS5 and distributes the 5 color signals input sequentially from the output terminal of the data D-IC chip 22 to the 5 data lines in different sequences. Then, the sequence of 5 color data signals to be applied to each demultiplexer DEMUX1 to DEMUXk becomes different in order of arrangement of data lines DL1 to DLn. In particular, the data D-IC chip 22 applies the 5 color data signals to the first demultiplexer DEMUX1 in sequence of first red data signal R1, second red data signal R2, first green data signal G1, second green data signal G2 and first blue data signal B1. The data D-IC chip 22 provides the 5 color data signals to the second demultiplexer DEMUX2 in sequence of fourth data signal R4, third red data signal R3, third green data signal G3, third blue data signal B3 and second blue data signal B2. In other words, the data D-IC chip allows the same color data signals to be continuously arranged. The first demultiplexer DEMUX1 selects the first to fifth data lines DL1 to DL5 in sequence of first data line DL1, fourth data line DL4, fifth data line DL5, second data lines DL2 and third data line DL3. To this end, the first demultiplexer DEMUX1 allows the first MOS transistor MN1 to respond to the first control signal CS1, and the second MOS transistors MN2 to the fourth control signal CS4, the third MOS transistor MN3 to the fifth control signal CS5, the fourth MOS transistor MN4 to the second control signal CS2, and the fifth MOS transistor MN5 to the third control signal CS3, respectively. Also, the second demultiplexer DEMUX2 selects the six to tenth data lines DL6 to DL10 in sequence of the tenth data line DL10, seventh data line DL7, eighth data line DL8, ninth data line DL9 and sixth data line DL6. To this end, the second demultiplexer DEMUX2 enables the first MOS transistor MN1 to respond to the fifth control signal CS5, the second MOS transistor MN2 to the second control signal Cs2, the third MOS transistor MN3 to the third control signal CS3, the fourth MOS transistor MN4 to the fourth control signal CS4, and the fifth MOS transistor MN5 to the first control signal CS1, respectively. In this manner, the 5 color data signals to be applied to each of the third to kth demultiplexers DEMUX3 to DEMUXk are arranged in sequence different from the arranging order of data lines. Further, the 5 MOS transistors included in each of the third to kth demultiplexers DEMUX3 to DEMUXk respond to the first to fifth control signals CS1 to CS5 in a sequence different in the order of arrangement of the data lines DL1 to DLn.

As described above, the same color data signals are continuously applied to the respective data lines after and/or before different color data signals are applied to the data lines, thereby minimizing the charge difference in the same color data signals in the picture elements. For example, if the color data signals are applied to the data lines DL1 TO DLn in sequence of red green and blue, each data line receiving the red data signal is coupled with adjacent data lines with green and blue data signals for a charged voltage to be affected or influenced twice. Also, the data lines inputting the green data signal are coupled with the adjacent data line with a blue data signal to change the charged voltage once. Further, each data line receiving the blue data signal does not vary the charged voltage. Thus, a voltage difference between the same color data signals is not generated. The same color data signals are charged in the picture cells such that the voltage drops by a constant or substantially constant value. Thus, stripes do not appear in the picture displayed on the liquid crystal panel 20. Further, the liquid crystal display driving method according to the present invention prevents picture distortion and enhances picture quality.

Figure 8:
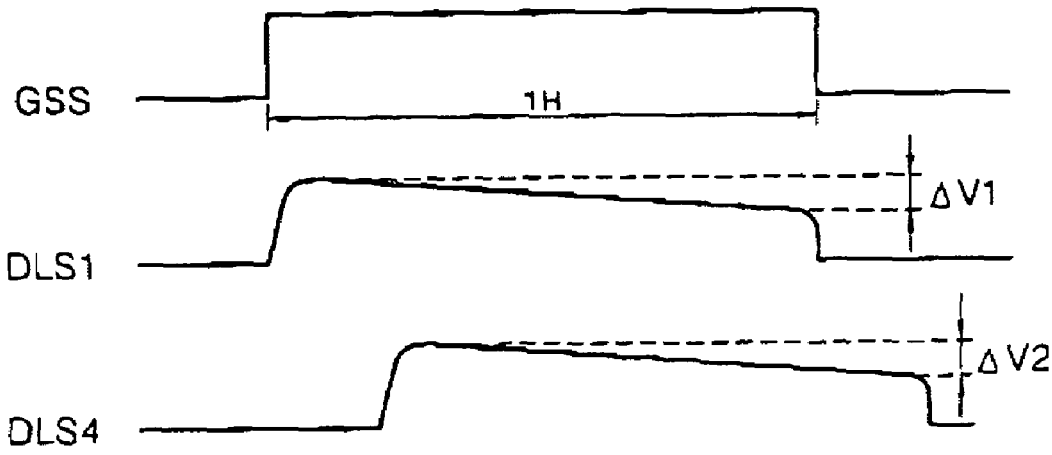
FIG. 8 is a waveform diagram for explaining the difference of leakage currents on the data lines DL1 to DLn of the liquid crystal panel as shown in FIG. 6.

Also, the liquid crystal display driving method according to a second embodiment of the present invention allows an amount of leakage current on each data line receiving the same color data signal to be substantially equal to each other because the same color data signals are consecutively applied to the data lines DL1 to DLn. In other words, the liquid crystal display driving method enables the data lines DL1 to DLn to hold the same color data signals during periods almost equal to each other. To this end, the same color data signals of equal voltage value are sampled respectively to the picture elements to have the absolute voltage value substantially equal to each other. For example, the first data line DL1 charges a first red data signal R1 from the first MOS transistor MN1 of the first demultiplexer DEMUX1 during the high logic period of the first control signal CS1, as shown in FIG. 8. The first data line DL1 maintains the charged voltage until the falling edged of the gate scanning signal GSS. Consequently, the first data line DL1 provides the picture element with a first voltage signal DLS1 being lower than the first red data signal R1 by a voltage of ΔV1, as shown in FIG. 8. Meanwhile, the fourth data line DL4 charges a second red data signal R2 from the fourth MOS transistor MN4 of the first demultiplexer DEMUX1 during the high logic period of the second control signal CS2. The fourth data line DL4 supplies the picture element with a fourth voltage signal DLS4 being lower than the second red data signal R2 by a voltage of ΔV2, as shown in FIG. 8. As shown in FIG. 7, the holding period of second red data signal on fourth data line DL4 is almost equal to that of the first red data signal R1 on the first data line DL1. Thus, the difference in the leakage currents on the data lines DL1 and DL4 is minimized. Further, the deviation between the first red data signal R1 and first voltage signal DLS1 is almost equal to that between the second red data signal R2 and the fourth voltage signal DLS4. Furthermore, the voltage value of the fourth voltage signal DLS4 on the fourth data line DL4 is almost equal to that of the first voltage signal DLS1 on the first line DL1. Accordingly, any difference in the brightness of the picture element of the first and fourth data lines is minimized. The liquid crystal display driving method according to the second embodiment of the present invention prevents a degradation of picture quality due to the difference in the leakage currents caused by the demultiplexers DEMUX1 to DEMUXk.

Figure 9:
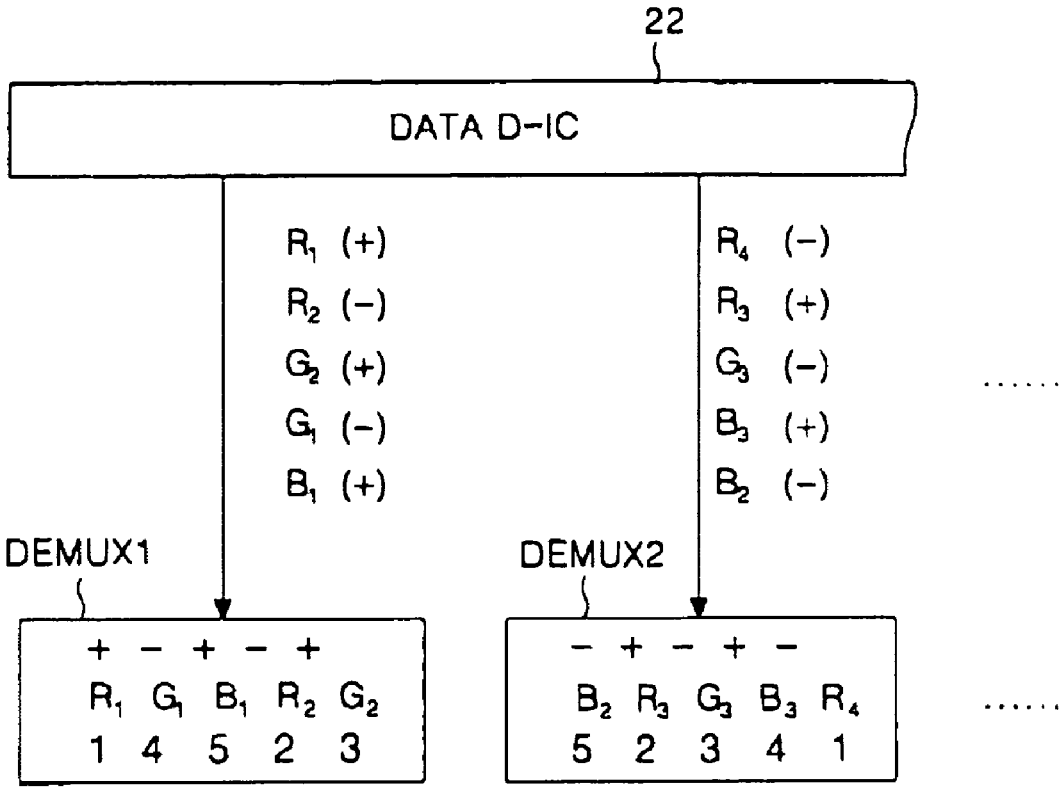
FIG. 9 is a schematic diagram for explaining the liquid crystal display device with a dot inversion system with demultiplexers having 5 output terminals, which is driven in the liquid crystal display device according to an embodiment of the present invention.

Further, the liquid crystal display driving method can be applied to the liquid crystal display device having a dot inversion system with demultiplexers. In this case, it is preferred to set up a demultiplexing sequence of demultiplexer with reference to the inversion of data signals to be applied to the data lines on the liquid crystal panel. FIG. 9 illustrates the liquid crystal display device according to the present invention where the liquid crystal display device is driven using a dot inversion system with demultiplexers, each having five output terminals. Referring to FIG. 9, the data D-IC chip 22 applies 5 color data signals to the first demultiplexer DEMUX1 in sequence of first red data signal R1 of positive polarity, second red data signal R2 of negative polarity, second green data signal G2 of positive polarity, first green data signal G1 of negative polarity and first blue data signal B1 of positive polarity. The data D-IC chip 22 provides the 5 color data signals to the second demultiplexer DEMUX2 in sequence of fourth red data signal R4 of negative polarity, third red data signal R3 of positive polarity, third green data signal G3 of negative polarity, third blue data signal B3 of positive polarity and second blue data signal B2 of negative polarity. In other words, the data D-IC chip 22 allows the same color data signals to be consecutively arranged according to its color and the positive and negative polarities to be alternated. The first demultiplexer DEMUX1 selects the first to fifth data lines DL1 to DL5 in sequence of first data line DL1, fourth data line DL4, fifth data line DL5, second data line DL2 and third data line DL3. The first demultiplexer DEMUX1 allows the first MOS transistor MN1 to respond to the first control signal CS1, the second MOS transistor MN 2 to the fourth control signal CS 4, the third MOS transistor MN3 to the fifth control signal CS5, the fourth MOS transistor MN4 to the second control signal CS2, and the fifth MOS transistor MN5 to the third control signal CS3, respectively. Also, the second demultiplexer DEMUX2 selects the sixth to tenth data lines DL6 to DL10 in sequence of the tenth data line DL10, seventh data line DL7, eighth data line DL8, ninth data line DL9 and sixth data line DL6. The second demultiplexer DEMUX2 enables the first MOS transistor MN1 to respond to the fifth control signal CS5, the second MOS transistor MN2 to the second control signal CS2, the third MOS transistor MN3 to the third control signal CS3, the fourth MOS transistor MN4 to the fourth control signal CS4, and the fifth MOS transistor MN5 to the first control signal CS1, respectively. In this manner, the 5 color data signals to be applied to each of the third to kth demultiplexers DEMUX3 to DEMUXk are arranged in sequence different from the order of the data lines.

Figure 10:
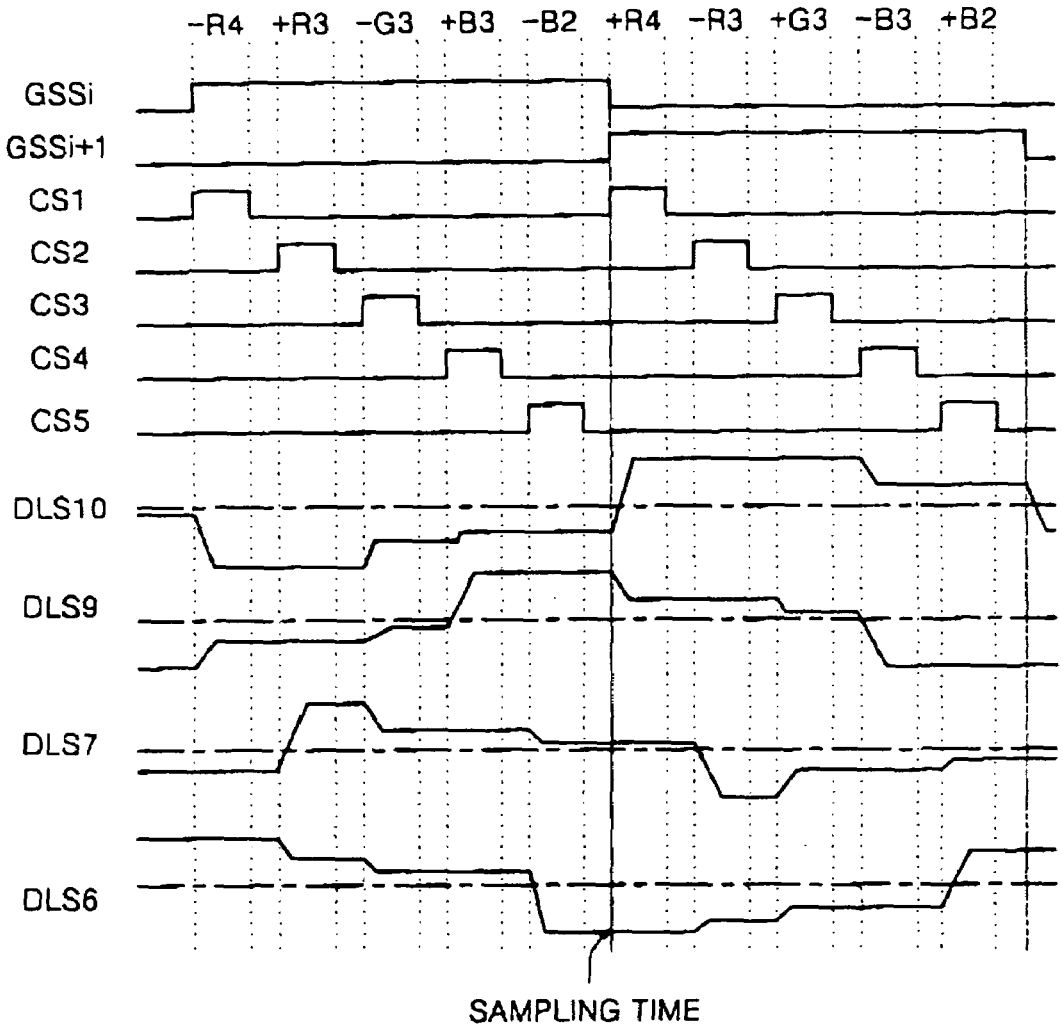
FIG. 10 is a waveform diagram for showing signals applied to each portion of the liquid crystal display device as shown in FIG. 9.

Such a liquid crystal display driving method according to the present invention can prevent stripes from occurring in the picture where the liquid crystal panel 20 is driven using a dot inversion system. This is possible because it is almost equal to the absolute value of the voltage signals charged in the picture elements on the data lines receiving the same color data signal, as shown in FIG. 10. FIG. 10 shows waveforms of voltage signals on data lines DL6, DL7, DL9 and DL10 connected to the second demultiplexer DEMUX2 when the ith and (i+1)th gate lines GLi and GLi+11 are sequentially driven by the scanning signals GSSi and GSSi+1. In FIG. 10, the second and third blue data signals B2 and B3 have equal or substantially equal absolute voltage values but with opposite electric polarity. Also, the third and fourth red data signals have equal or substantially equal absolute voltage values but with opposite electric polarity. In particular, the tenth data line DL10 charges the fourth red data signal R4 of negative polarity from the fifth MOS transistor MN5 of the second demultiplexer DEMUX2 during the high logic period of the first control signal CS1. The tenth data line DL10 must be floated while the first control signal CS1 is in the low logic state. But, the tenth data line DL10 discharges the charged voltage signal DLS10 to the adjacent data lines DL9 through the coupling capacitor Cc at the rising edge of the fourth control signal CS4, by the third blue data signal B3 of positive voltage level on the ninth data line DL9. However, the tenth data line DL10 discharges again the charged voltage signal DLS10 to the eleventh data line DL11 through the coupling capacitor Cc by a fourth green data signal G4 of positive voltage level at the rising edge of the third control signal CS3 (not shown). The tenth data line DL10 provides the voltage signal DLS10 having an absolute value lower than the fourth red data signal R4 at the falling edge of the ith gate scanning signal GSSi. On the other hand, the seventh data line DL7 discharges twice after charging the third red data signal R3. In particular, the seventh data line DL7 charges the third red data signal R3 of positive voltage level from the second MOS transistor MN2 of the second demultiplexer DEMUX2 during the high logic period of the second control signal CS2. The seventh data line DL7 discharges the charged voltage signal DLS7 to the eighth data line DL8 through the coupling capacitor at the rising edge of the third control signal CS3, due to the third green data signal G3 of negative voltage level. Also, the seventh data line DL7 discharges the charged voltage signal DLS7 to the sixth data line DL6 through the coupling capacitor at the rising edge of the fifth control signal CS5, due to the second blue data signal B2 of negative voltage level. As described above, the seventh data line DL7 discharges identically with the tenth data line DL10 such that the voltage signal DLS7 has an absolute voltage value equal to that of the voltage signal DLS10 on the tenth data line DL10 at the falling edge of the ith scanning signal GSSi (i.e., sampling time point of data signals). Also, the seventh data line DL7 holds the charged voltage signal DLS7 during a period substantially equal to that of the voltage signal DLS10 held by the tenth data line DL10. Consequently, the voltage signal DLS7 on the seventh data line DL7 is almost equal to the voltage signal DLS10 on the data line DL10. Meanwhile, the sixth data line DL6 does not discharge the charged voltage signal DLS6 to the fifth or seventh data line DL5 or DL7 because of the charging of the second blue data signal B2 of negative polarity at the rising edge of the fifth control signal CS5. The sixth data line DL6 provides the voltage signal DLS6 having the absolute value equal to the second blue data signal B2 at the falling edge of the ith gate scanning signal GSSi. Also, the ninth data line DL9 does not discharge the charged voltage signal DLS9 to the eighth or tenth data line DL8 or DL10, due to the charging of the third blue data signal B3 at the rising edge of the fourth control signal CS4 which is enabled later than the first and third control signals CS1 and CS3. The ninth data line DL9 provides the voltage signal DLS9 having an absolute value equal to the third blue data signal B3 at the falling edge of the ith gate scanning signal GSSi. Consequently, the voltage signal DLS6 on the sixth data line DL6 is almost equal to the voltage signal DLS9 on the data line DL9 with a slight difference in the loading period. As described above, the same color data signals are applied to the picture element such that the absolute voltage values equal almost to each other, thereby eliminating the stripes in the picture displayed on the liquid crystal panel 20. Accordingly, the liquid crystal display driving method according to the present invention enhances the quality of a picture.

Figure 11:
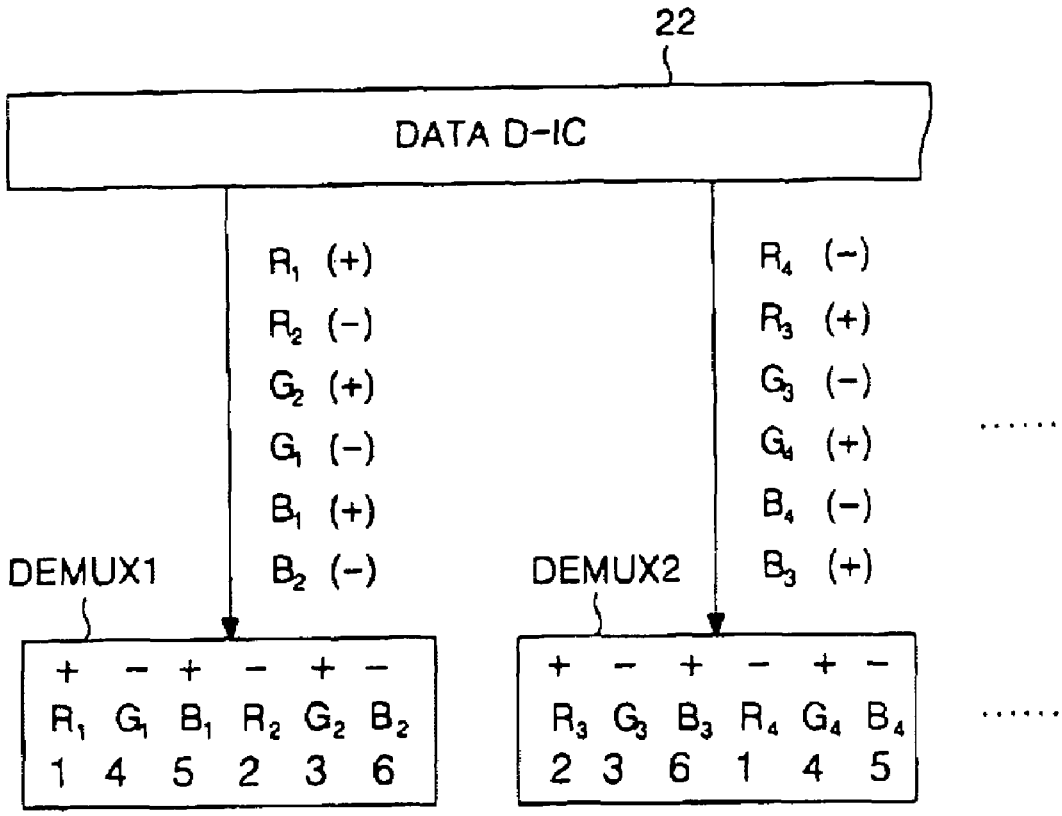
FIG. 11 is a schematic diagram for explaining the liquid crystal display device with a dot inversion system with demultiplexers having 6 output terminals, which is driven in the liquid crystal display device according to an embodiment of the present invention.

FIG. 11 depicts a liquid crystal display device according to a third embodiment of the present invention where the liquid crystal display device is driven by a dot inversion system with demultiplexers each having six output terminals. In this case, the data D-IC CHIP 22 applies 6 color data signals to the first demultiplexer DEMUX1 in sequence of first red data signal R1 of positive polarity, second red data signal R2 of negative polarity, second green data signal G2 of positive polarity, first green data signal G1 of negative polarity, first blue data signal B1 of positive polarity and second blue data signal B2 of negative polarity. The data D-IC CHIP 22 provides the 6 color data signals to the second demultiplexer DEMUX1 in sequence of fourth red data signal R4 positive polarity, fourth red data signal R4 of negative polarity, fourth green data signal G4 of negative polarity, third green data signal G3 of positive polarity, third blue data signal B3 of positive polarity and fourth blue data signal B4 of negative polarity. In the other words, the data D-IC CHIP 22 allows the same color data signals to be consecutively arranged according to color and the positive and negative polarities to be alternated. The first demultiplexer DEMUX1 selects the first to sixth data lines DL1 to DL6 in sequence of first data line DL1, fourth data line DL4, fifth data line DL5, second data line DL2, third data line DL3 and sixth data line DL6. Also, the second demultiplexer DEMUX2 selects the seventh to twelfth data lines DL6 to DL12 in sequence of the tenth data line DL10, seventh data line DL7, eighth data line DL8, eleventh data line DL11, twelfth data line DL12 and ninth data line DL9. In this manner, the 6 color data signals to be applied to each of the third to kth demultiplexers DEMUX3 to DEMUXk are arranged in sequence different from the order of the data lines. The liquid crystal display driving method according to the third embodiment of the present invention allows the same color data signals to be applied to the picture cells in such a manner as to have the absolute voltage values almost equal to each other, thereby eliminating the stripes in the picture displayed on the liquid crystal panel 20. Accordingly, the liquid crystal display driving method according to the third embodiment of the present invention enhances the picture quality.

Figure 12:
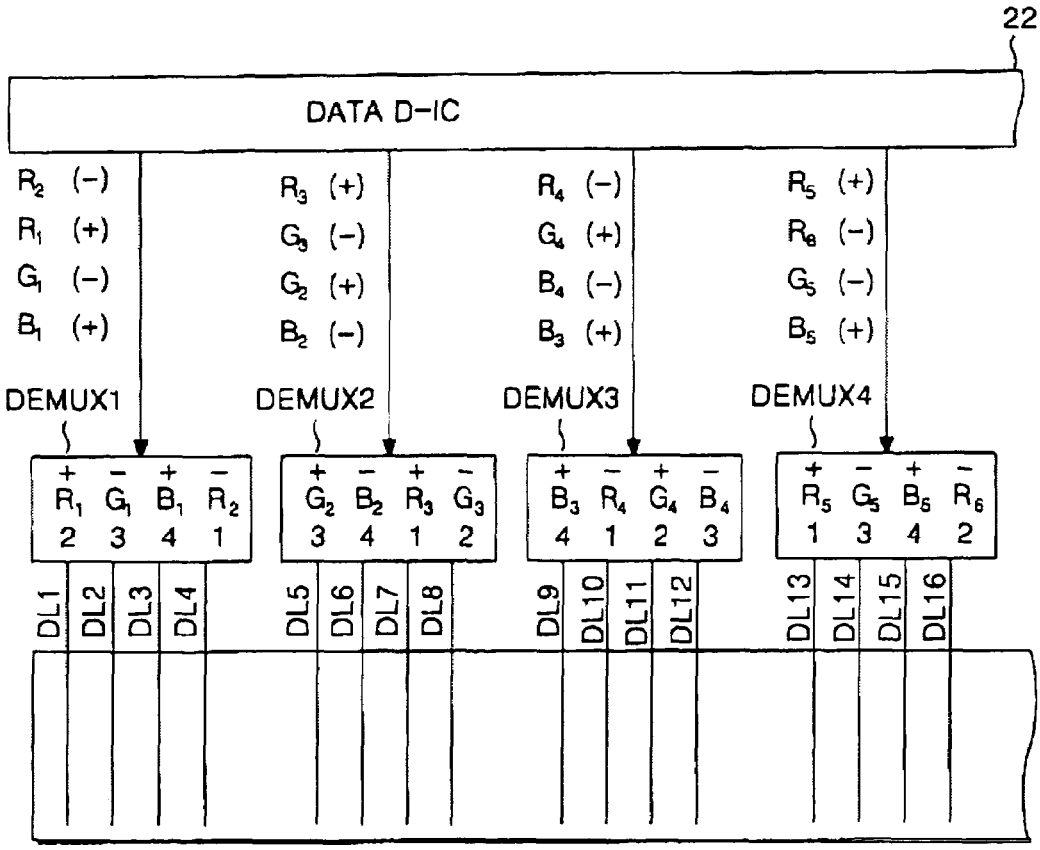
FIG. 12 is a schematic diagram for explaining the liquid crystal display device with a dot inversion system with demultiplexers having 4 output terminals, which is driven in the liquid crystal display device according to an embodiment of the present invention.

FIG. 12 explains the liquid crystal display drive according to a fourth embodiment of the present invention where the liquid crystal display device is driven by a dot inversion system with demultiplexers each having four output terminals. In this case, the data D-IC CHIP 22 applies the 4 color data signals to the first demultiplexer DEMUX1 in sequence of second red data signal R2 of negative polarity, first red data signal R1 of positive polarity, first green data signal G1 of negative polarity and first blue data signal B1 of positive polarity. The data D-IC CHIP 22 also applies the 4 color data signals to the second demultiplexer DEMUX2 in sequence of third red data signal R3 of positive polarity, third green data signal G3 of negative polarity, second green data signal G2 of positive polarity and second blue data signal B2 of negative polarity. Further, the data D-IC CHIP 22 also supplies the 4 color data signals to the third demultiplexer DEMUX3 in sequence of fourth red data signal R4 of negative polarity, fourth green data signal G4 positive polarity, fourth blue data signal B4 of negative polarity and third blue data signal B3 of positive polarity. Furthermore, the data D-IC CHIP 22 applies the 4 color data signals to the fourth demultiplexer DEMUX4 in sequence of fifth red data signal R5 of positive polarity, sixth red data signal R6 of negative polarity, fifth green data signal G5 of negative polarity, fifth blue data signal B5 of positive polarity. In other words, the data D-IC CHIP 22 allows the same color data signals to be consecutively arranged according to color. However, the data D-IC chip 22 can not alternate the positive and negative polarities for the color data signals applied to some demultiplexers (for example, fourth demultiplexer DEMUX4). The first demultiplexer DEMUX1 selects the first to fourth data lines DL1 to DL4 in sequence of the first data line DL1, fourth data line DL4, second data line DL2 and third data line DL3. Also, the second demultiplexer DEMUX2 selects the fifth to eighth data lines DL5 to DL8 in sequence of the seventh data line DL7, eighth data line DL8, fifth data line DL5 and sixth data line DL6. Further, the third demultiplexer DEMUX3 selects the ninth to twelfth data lines DL9 to DL12 in sequence of the tenth data line DL10, eleventh data line DL11, twelfth data line DL12 and ninth data line DL9. Furthermore, the fourth demultiplexer DEMUX4 selects the thirteenth to sixteenth data lines DL13 to DL16 in sequence of the thirteenth data line DL13, sixteenth data line DL16, fourteenth data line DL14 and fifteenth data line DL15.

Since the color data signals to be applied from the data D-IC chip 22 to some demultiplexers do not alternate in polarity, this liquid crystal display driving method forces the same color data signals to be applied to the picture cells in such a manner as to have different voltage values. However, by designing the data driver circuit corresponding to four output demultiplexers, the fourth embodiment can achieve the desired result of enhancing picture quality, as discussed with other embodiment of the present invention.

FIGS. 9 to 11 shows a liquid crystal display driving method according to the present invention in which the liquid crystal display device of a dot inversion system with demultiplexers each have output terminals corresponding to an odd number preferably higher than 5. Also, the liquid crystal display driving method according to the present invention is applicable to liquid crystal display devices of a dot inversion system with demultiplexers each having output terminals corresponding to a multiple of 6.

Figure 13:
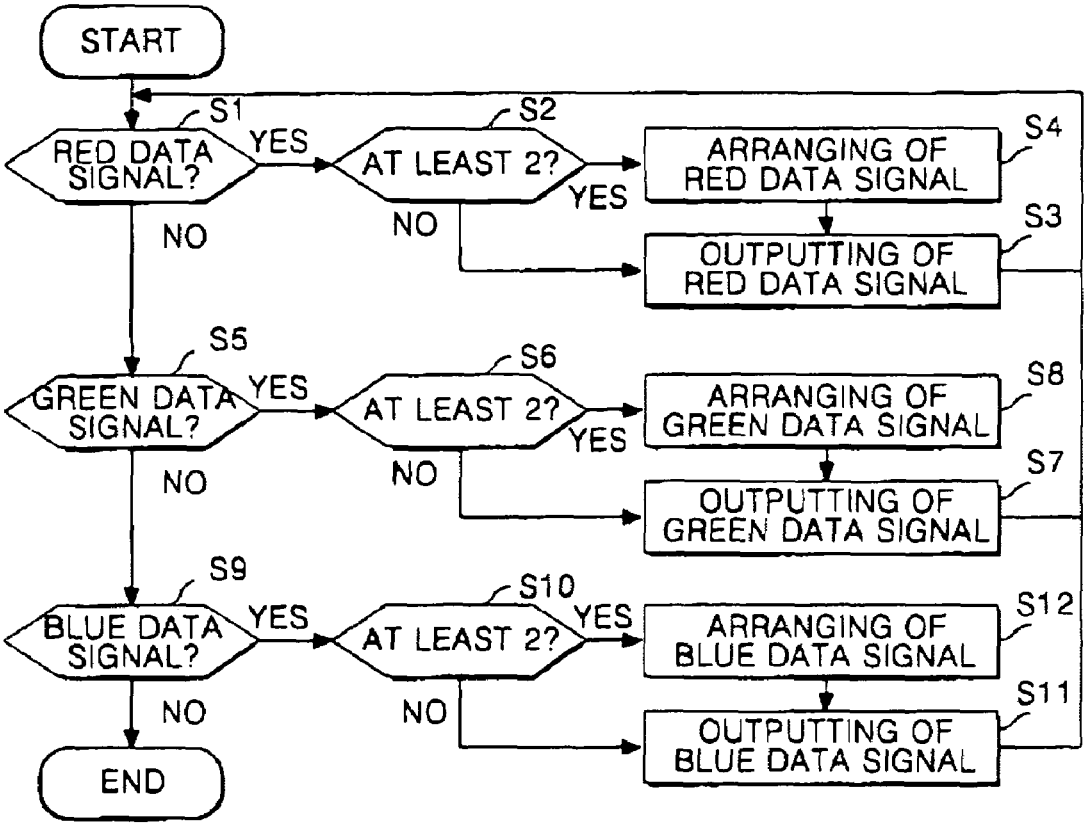
FIG. 13 is a flowchart explaining the operation of the data D-IC chip driven in the liquid crystal display driving method according to the present invention.

FIG. 13 is a flowchart explaining the operation the data D-IC CHIP in the liquid crystal display driving method according to the present invention. In a first step S1 of FIG. 13, the data D-IC CHIP 22 checks whether the data signal to be applied to the demultiplexers DEMUX1 to DEMUXk is a red data signal. If the data signal to be applied to the demultiplexers DEMUX1 to DEMUXk is a red data signal in the first step S1, the data D-IC CHIP 22 checks whether there are at least two red data signals to be applied to the respective demultiplexers DEMUX1 to DEMUXk in step S2. When there is only one red data signal to the applied to the respective demultiplexers DEMUX1 to DEMUXk in step S2, the data D-IC CHIP 22 supplies the red data signal to the respective demultiplexers DEMUX1 to DEMUXk, as shown in third step S3. On the other hand, if there are at least two red data signals to be applied to the respective demultiplexers DEMUX1 to DEMUX2, the data D-IC CHIP 22 arranges at least 2 red data signals in sequence with alternating polarities of the data signals, as shown in the fourth step S4. After the fourth step S4, the data D-IC CHIP 22 performs the third step S3 and allows the arranged red data signals to be applied to the respective demultiplexers DEMUX1 to DEMUXk.

If the data signal to be applied to the demultiplexers DEMUX1 to DEMUXk is not a red data signal in the first step S1, the data D-IC CHIP 22 checks whether the data signal to be applied to the demultiplexers DEMUX1 to DEMUXk is a green data, as shown in the fifth step S5. If the data signal to be applied to the demultiplexers DEMUX1 to DEMUXk is a green data signal in the fifth step S5, the data D-IC CHIP 22 checks whether there are at least two green data signal to be applied to the respective demultiplexers DEMUX1 to DEMUXk, as shown in the sixth step S6. If there is only one green data signal to be applied to the respective demultiplexers DEMUX1 to |DEMUXk in the sixth step S6, the data D-IC CHIP 22 supplies the green data signal to the respective demultiplexers DEMUX1 to DEMUXk, as shown in the seventh step S7. On the other hand, if there are at least two green data signals to be applied to the respective demultiplexers DEMUX1 to DEMUX2 in step S6, the data D-IC CHIP 22 arranges at least 2 green data signals in sequence with alternately inverting polarities, as shown in the eighth step S8. After the eighth step S8, the data D-IC CHIP 22 performs the seventh step S7 and allows the arranged green data signals to be applied to the respective demultiplexers DEMUX1 to DEMUXk.

Further, when the data signal to be applied to the demultiplexers DEMUX1 to DEMUXk is not a green data signal in the fifth step S5, the data D-IC CHIP 22 checks whether the data signal to be applied to the demultiplexers DEMUX1 to DEMUXk is a blue data signals, as shown in the ninth step S9. When the data signal to be applied to the demultiplexers DEMUX1 to DEMUXk is the blue data signal in the ninth step S9, the data D-IC CHIP 22 checks whether there are at least two blue data signals to be applied to the respective demultiplexers DEMUX1 to DEMUXk, as shown in the tenth step S10. If there is only one blue data signal to be applied to the respective demultiplexers DEMUX1 to |DEMUXk in the tenth step S10, the data D-IC CHIP 22 supplies the blue data signal to the respective demultiplexers DEMUX1 to DEMUXk, as shown in the eleventh step S11. On the other hand, if there are at least two blue data signals to be applied to the respective demultiplexers DEMUX1 to DEMUX2 in the tenth step S10, the data D-IC CHIP 22 arranges at least two blue data signals in sequence with alternately inverting polarities, as shown in the twelfth step S12. After the twelfth step S12, the data D-IC CHIP 22 performs the eleventh step S11 and allows the arranged blue data signals to be sequentially applied to the respective demultiplexers DEMUX1 to DEMUXk. As shown in FIG. 13, the data D-IC CHIP applies consecutively the same color data signals to the respective demultiplexers after and/or before different color data signals are supplied to the respective demultiplexers, thereby minimizing differences between the same color data signals charged in picture elements.

As described above, in the liquid crystal display driving method according to the present invention, the same color data signals are consecutively applied to the respective data lines after and/or before different color data signals are supplied to the data lines, thereby minimizing voltage differences between the same color data signals charged in the picture elements. To this end, the same color data signals are charged in the picture cells in such a manner as to be reduced by a constant voltage value. As a result, stripes do not appear in the picture displayed on the liquid crystal panel. Further, the liquid crystal display driving method according to the present invention prevents picture distortion and enhances picture quality.

Although the present invention has been explained by the embodiments shown in the drawing hereinbefore, it should be understood to the ordinary skilled person in the art that the present invention is not limited to the embodiments, but rather that various changes or modifications thereof are possible without departing from the spirit of the invention. Accordingly, the scope of the invention shall be determined only the appended claims and their equivalents.

What is claimed is:

1. A method for driving a liquid crystal display device having a demultiplexer unit connected between a data driving circuit and a plurality of data lines on a liquid crystal panel, the demultiplexer unit distributing color data signals from any one of the output terminals of the data driving circuit to the plurality of the data lines on the liquid crystal panel, the method comprising;

classifying color data signal to be applied to the demultiplexer unit from the data driver circuit by colors;

consecutively providing the color data signals to the demultiplexer unit by the driver in a sequence including color data signals of a plurality of colors, the sequence having consecutive color data signals having a same color; and consecutively providing the consecutive color data signals of the sequence having the same color to non-adjacent data lines on the liquid crystal panel by the demultiplexer unit.

2. The method of claim 1, wherein the color data signals are applied to the data lines on the liquid crystal panel in a combination of sequences of color data signals of red, green and blues.

3. The method of claim 2, wherein the color data signals are applied to the data lines on the liquid crystal panel in a sequence of red, green and blue signals.

4. The method of claim 2, wherein the color data signals are applied to the data lines on the liquid crystal panel in a sequence of green, blue and red signals.

5. The method of claim 2, wherein the color data signals are applied to the data lines on the liquid crystal panel in a sequence of blue, red and green signals.

6. The method of claim 1, wherein the classifying step includes a step includes arranging the color data signals having the same color according to a sequence of dot inversion system where each contiguous pixel of the liquid crystal panel has a reverse polarity.

7. The method of claim 1, wherein the demultiplexer unit includes a plurality of demultiplexers.

8. The method of claim 7, wherein each of the plurality of the demultiplexers is connected to at least five data lines of the liquid crystal panel.

9. The method of claim 7, wherein each of the plurality of the demultiplexers is connected to an odd number of data lines.

10. The method of claim 7, wherein each of the plurality of the demultiplexers is connected to data lines in a multiple of six.

11. A liquid crystal display device comprising a data driving unit, a liquid crystal panel having a plurality of data lines and a demultiplexer unit connected between a data driving circuit and the liquid crystal panel and distributing color data signals from any one of the output terminals of the data driving circuit to the plurality of the data lines on the liquid crystal panel, wherein the data driver consecutively provides the color data signals in a sequence that includes color data signals of a plurality of colors, the sequence having consecutive color data signals having the same color to the demultiplexer unit, and wherein the demultiplexer unit consecutively provides the consecutive color data signals of the sequence having the same color to non-adjacent data lines on the liquid crystal panel.

12. The liquid crystal display device of claim 11, wherein the color signal are applied to the data line in a combination of sequences of color data signals of red, green and blues.

13. The liquid crystal display device of claim 12, wherein the color data signals are applied to the data lines on the liquid crystal panel in a sequence of green, blue and red signals.

14. The liquid crystal display device of claim 12, wherein the color data signals are applied to the data lines on the liquid crystal panel in a sequence of blue, red and green signals.

15. The liquid crystal display device of claim 11, wherein the color data signals are applied to the data lines on the liquid crystal panel in a sequence of red, green and blue signals.

16. The liquid crystal display device of claim 11, wherein the data signals are applied to the demultiplexer unit having a same color according to a sequence of dot inversion system where each contiguous pixel of the liquid crystal panel has a reverse polarity.

17. The liquid crystal display device of claim 11, wherein the demultiplexer unit includes a plurality of demultiplexers.

18. The liquid crystal display device of claim 17, wherein each of the plurality of demultiplexers is connected to at least 5 data lines on the liquid crystal panel.

19. The liquid crystal display device of claim 17, wherein each of the plurality of the demultiplexers is connected to the data lines of odd number.

20. The liquid crystal display device of claim 17, wherein each of the plurality of the demultiplexers is connected to a number of data lines in multiple of six.

* * * * *